US009863144B2

(12) United States Patent
Kitahara et al.

(10) Patent No.: US 9,863,144 B2
(45) Date of Patent: Jan. 9, 2018

(54) DOME-SHAPED ROOF CONSTRUCTION METHOD AND DOME-SHAPED ROOF INTERMEDIATE STRUCTURE

(71) Applicant: IHI Corporation, Tokyo (JP)

(72) Inventors: Shin Kitahara, Tokyo (JP); Masaki Takahashi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/166,435

(22) Filed: May 27, 2016

(65) Prior Publication Data

US 2016/0273216 A1 Sep. 22, 2016

Related U.S. Application Data

(63) Continuation of application No. PCT/JP2014/082108, filed on Dec. 4, 2014.

(30) Foreign Application Priority Data

Dec. 10, 2013 (JP) ..... 2013-255452

(51) Int. Cl.

| | |
|---|---|
| ***E04B 7/10*** | (2006.01) |
| ***E04H 7/06*** | (2006.01) |
| ***E04B 1/35*** | (2006.01) |
| ***E04G 21/16*** | (2006.01) |

(Continued)

(52) U.S. Cl.

CPC ..... *E04B 7/102* (2013.01); *E04B 1/3511* (2013.01); *E04B 7/105* (2013.01); *E04G 21/167* (2013.01);

(Continued)

(58) Field of Classification Search

CPC ..... E04G 21/167; E04B 7/102; E04B 7/105; E04B 1/351; E04H 7/02

(Continued)

(56) References Cited

U.S. PATENT DOCUMENTS 3,130,488 A * 4/1964 Lindstrom ..... E04H 7/065 29/428
3,866,385 A * 2/1975 Al Haj Issa ..... E04B 1/35 52/749.12

(Continued)

FOREIGN PATENT DOCUMENTS

CN 101341303 A 1/2009
JP 48-67808 A 9/1973

(Continued)

OTHER PUBLICATIONS

International Search Report dated Jan. 13, 2015 in PCT/JP2014/082108 (4 pages).

*Primary Examiner* — Paola Agudelo
(74) *Attorney, Agent, or Firm* — Rothwell, Figg, Ernst & Manbeck, P.C.

(57) ABSTRACT

A method of constructing a dome-shaped roof on a cylindrical tank body includes processes of assembling roof beams into the tank body in a radial shape to form a structural skeleton unit of the dome-shaped roof, attaching wheels to front end portions of the roof beams and causing the wheels to abut an inner surface of the tank body in a state in which the wheels are able to roll in a vertical direction, lifting the structural skeleton unit by jack-up units installed at an upper end side of the tank body and causing the wheels to roll along the inner surface of the tank body to travel upward, and directly or indirectly attaching and fixing the structural skeleton unit to an upper end portion of the tank body after the structural skeleton unit is lifted to the upper end side of the tank body.

6 Claims, 6 Drawing Sheets

(51) Int. Cl.

| | |
|---|---|
| ***E04H 7/02*** | (2006.01) |
| ***E04H 15/62*** | (2006.01) |
| *E04H 7/20* | (2006.01) |
| *E04B 1/32* | (2006.01) |

(52) U.S. Cl.
CPC ..... *E04H 7/02* (2013.01); *E04H 7/065* (2013.01); *E04H 15/62* (2013.01); *E04B 2001/3229* (2013.01); *E04B 2001/3235* (2013.01); *E04H 7/20* (2013.01)

(58) Field of Classification Search
USPC ..... 52/745.07, 745.2
See application file for complete search history.

(56) References Cited

U.S. PATENT DOCUMENTS 4,233,794 A * 11/1980 Mayer ..... E04B 1/3211 403/171
4,541,210 A * 9/1985 Cook ..... E04B 7/102 52/745.01
5,870,872 A * 2/1999 Hinnen ..... E21D 11/40 182/141
6,430,892 B1 * 8/2002 Castano ..... E04B 1/3211 52/123.1
7,152,384 B1 * 12/2006 McCarty ..... E04B 1/3211 52/639
8,307,605 B2 * 11/2012 McCarty ..... E04B 7/08 52/745.07
8,944,737 B2 2/2015 Black
2011/0008135 A1 1/2011 Black

FOREIGN PATENT DOCUMENTS

| | | | |
|---|---|---|---|
| JP | 60-81396 | U | 6/1985 |
| JP | 10-102813 | A | 4/1998 |
| JP | 10-237886 | A | 9/1998 |
| JP | 10-280543 | A | 10/1998 |
| JP | 10-325182 | A | 12/1998 |

* cited by examiner

DOME-SHAPED ROOF CONSTRUCTION METHOD AND DOME-SHAPED ROOF INTERMEDIATE STRUCTURE

This application is a continuation application based on a PCT Patent Application No. PCT/JP2014/082108, filed on Dec. 4, 2014, whose priority is claimed on Japanese Patent Application 2013-255452, filed Dec. 10, 2013. The contents of both the PCT Application and the Japanese Application are incorporated herein by reference.

TECHNICAL FIELD

Embodiments described herein relates to a construction method of a dome-shaped roof and an intermediate structure of the dome-shaped roof.

RELATED ART

A double wall cylindrical tank having an inner tank and an outer tank is used to store a cryogenic liquid such as liquefied natural gas (LNG), liquefied petroleum gas (LPG), or the like. In such a cylindrical tank, a dome-shaped roof is used as a roof of an outer tank side. As a method of constructing the dome-shaped roof using a lift-up method, methods disclosed in Patent Document 1 and Patent Document 2 are known.

In general, when the dome-shaped roof is jacked (lifted) up, in order to suppress deformation of the roof in the vicinity of a hanging point caused by jacking it up, reinforcement shape steel such as H-section steel or the like is attached to the entire circumference of an outer circumferential portion of the dome-shaped roof in a ring shape as a scaffolding material.

CITATION LIST

Patent Document

[Patent Document 1] Japanese Unexamined Patent Application, First Publication No. H10-325182

[Patent Document 2] Japanese Unexamined Patent Application, First Publication No. H10-280543

SUMMARY

However, since the reinforcement shape steel attached in the ring shape is attached to the entire circumference of the outer circumferential portion of the dome-shaped roof, attachment of the shape steel by welding or the like is time-consuming, and further, since the amount of the shape steel (the H-section steel) used in the entire ring is increased, the material cost is increased. In addition, since the weight of the ring is increased, the load generated when the roof is jacked up is also increased.

In consideration of the above-mentioned circumstances, the present disclosure is directed to provide a construction method of a dome-shaped roof and an intermediate structure of the dome-shaped roof that are capable of reducing cost while facilitating construction by reducing the load generated particularly when the dome-shaped roof is jacked up.

The present disclosure provides a method of constructing a dome-shaped roof in a cylindrical tank body, the construction method including: a process of assembling roof beams into the tank body in a radial shape when seen in a plan view to form a structural skeleton unit of the dome-shaped roof; a process of attaching wheels to front end portions of the roof beams and causing the wheels to abut an inner surface of the tank body in a state in which the wheels are able to roll in a vertical direction; a process of lifting the structural skeleton unit by jack-up units installed at an upper end side of the tank body and causing the wheels to roll along the inner surface of the tank body to travel upward; and a process of directly or indirectly attaching and fixing the structural skeleton unit to an upper end portion of the tank body after the structural skeleton unit is lifted to the upper end side of the tank body.

According to the present disclosure, since the wheels are attached to the front end portion of the roof beams and the wheels roll along the inner surface of the tank body when the structural skeleton unit is lifted by the jack-up units, as the front end portions of the roof beams receive a reactive force from the inner surface of the tank body via the wheels, deformation of the roof beams can be suppressed. In addition, since only the wheels are attached to the front end portions of the roof beams without attachment of a scaffolding material such as shape steel or the like to the entire outer circumference of the structural skeleton unit, attachment of the wheels to the roof beams is relatively easy and labor for attachment is reduced, and since the number of wheels may be equal to the number of roof beams that are attachment targets, cost of labor or materials can be reduced. Accordingly, cost required for construction of the dome-shaped roof can be reduced. Further, since the wheels roll along the inner surface of the tank body, the load generated when the roof is jacked up can be reduced.

DESCRIPTION OF EMBODIMENT

Hereinafter, a construction method of a dome-shaped roof and an intermediate structure of the dome-shaped roof of the present disclosure will be described in detail with reference to the accompanying drawings. Further, in the following drawings, in order to show components in recognizable sizes, the scales of the components may be appropriately varied. In addition, in the following description, as a cylindrical tank including a dome-shaped roof, a ground type duplex shell storage tank configured to store LNG is an exemplary example.

Figure 1:
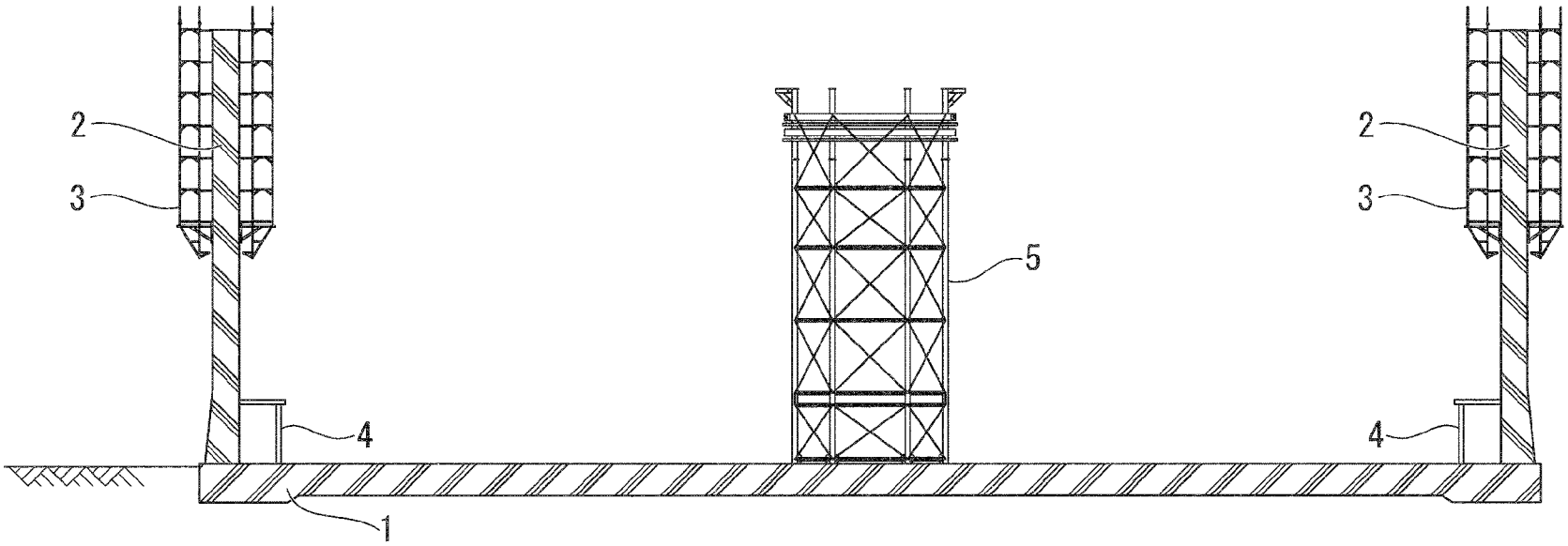
FIG. 1 is a side cross-sectional view showing a process according to an embodiment of the present disclosure.

First, as shown in FIG. 1, construction of a base slab (a bottom portion of an outer tank) 1 having substantially a disk shape is performed, and a bottom portion liner (not shown) is formed on an upper surface thereof. Next, a sidewall 2 of the outer tank (dike) is formed at an outer circumferential edge portion of the base slab 1. Since the sidewall 2 is a tank body according to the present disclosure, the sidewall 2 is formed of prestressed concrete (PC) in a cylindrical shape. Further, while construction of the dome-shaped roof (to be described below) may start after the sidewall 2 is constructed in the number of stages that form a final height (size), in order to reduce a construction period of the entire tank, in the embodiment, a portion of the sidewall 2, for example, the number of stages corresponding to about a half of the final height, is first stacked and formed.

A construction opening (not shown) is formed at a lower stage side of the sidewall 2 at the portion of the sidewall 2 of the outer tank formed in this way. In addition, in order to form the sidewall 2 constituted by the number of stages corresponding to the final height obtained by stacking the remaining stages of sidewalls thereon at the portion of the sidewall 2, assembly of mold for the remaining stages or the like should be performed. For this purpose, a scaffold 3 is installed on the portion of the sidewall 2.

When the portion of the sidewall 2 of the outer tank is formed in this way, a plurality of legged trestles 4 configured to assemble an inner tank side plate are installed at an inner circumferential surface side of the sidewall 2 in a circumferential direction thereof. The legged trestle 4 is a gate shaped stand configured to support the side plate of the inner tank (not shown) when the inner tank is formed thereafter. In addition, in the sidewall 2, a roof stand 5 is assembled at a central section of the base slab 1. Further, parallel to these, concrete is sequentially poured into the remaining stages of the sidewall 2, and the sidewall 2 is formed. Further, in construction of the sidewall 2, as the sidewall 2 of the upper side is sequentially formed, the scaffold 3 is also sequentially moved upward.

Figure 3:
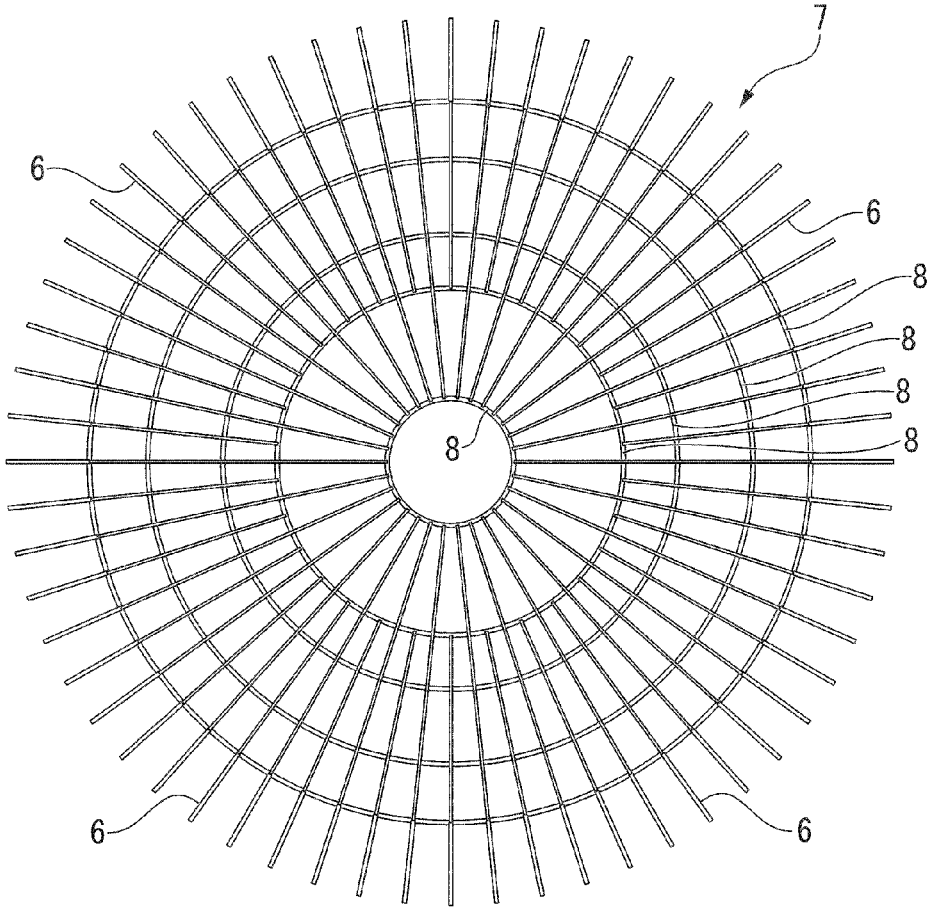
FIG. 3 is a plan view of a structural skeleton unit of an outer tank roof.

Next, roof beams 6 constituted by shape steel such as H-section steel and so on are assembled on the roof stand 5 as shown in FIG. 3 in a radial shape as shown in FIG. 3 to form a structural skeleton unit 7 of an outer tank roof that will become the dome-shaped roof according to the present disclosure. Further, before formation of the structural skeleton unit 7, an inner tank roof (not shown) or a sidewall of an inner tank may be formed.

Figure 2:
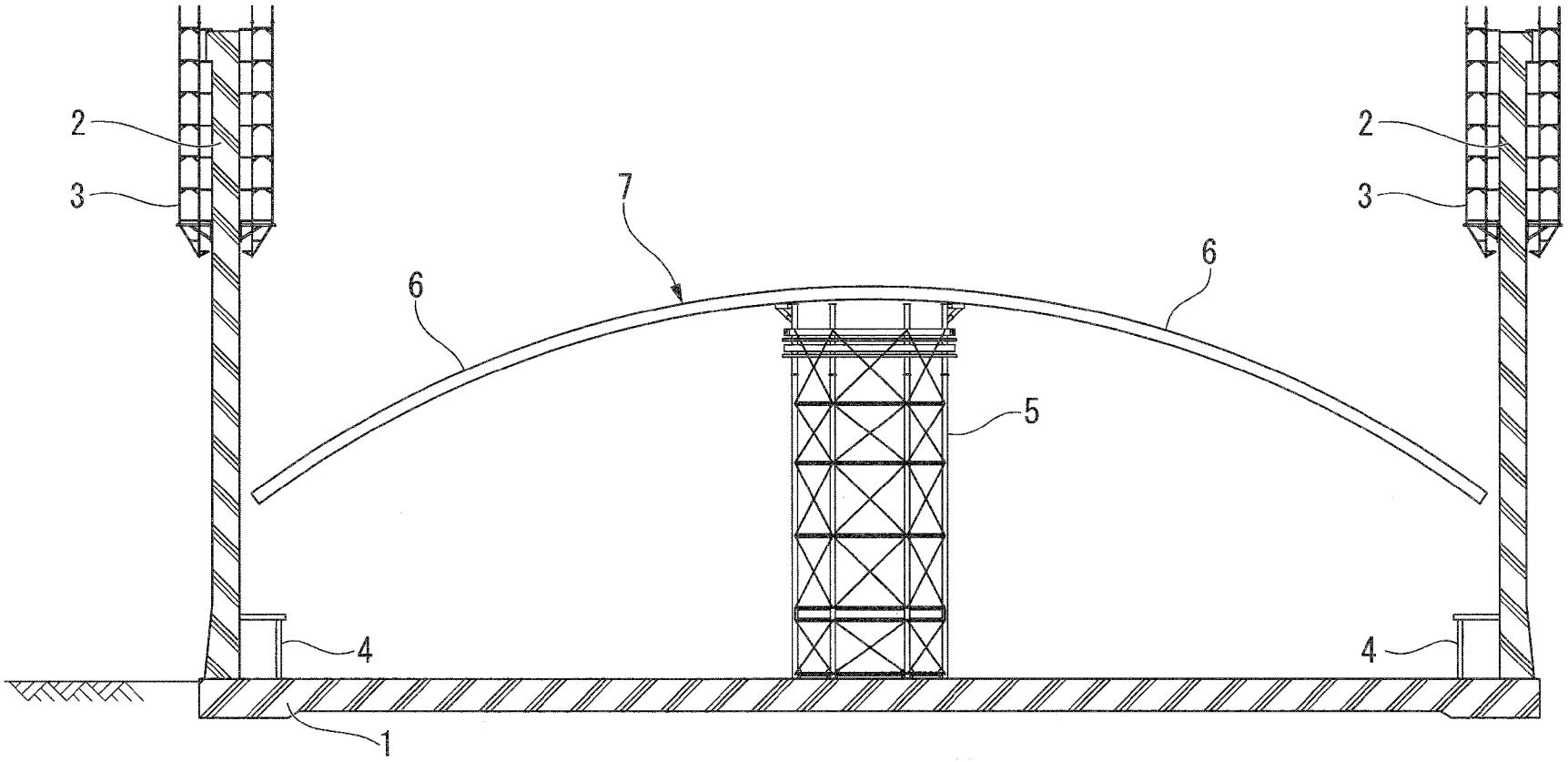
FIG. 2 is a side cross-sectional view showing the process according to the embodiment of the present disclosure.

When the structural skeleton unit 7 is manufactured, as shown in FIG. 2, the roof beams 6 are assembled in a radial shape when seen in a plan view, connecting beams 8 configured to connect the roof beams 6 are assembled in a plurality of ring shapes that are concentric with each other when seen in a plan view about the roof beams 6 that form the above-mentioned radial shape, and connecting sections are welded. As a result, the structural skeleton unit 7 having a dome shape as shown in FIG. 2 is formed. In addition, roof plates (not shown) are adhered and welded onto the structural skeleton unit 7 assembled in this way. In the roof plates, blocks of the roof plates are connected on the base slab 1 to a predetermined shape that is as large as possible, lifted by a crane, and adhered, welded and fixed onto the structural skeleton unit 7.

Figure 4:
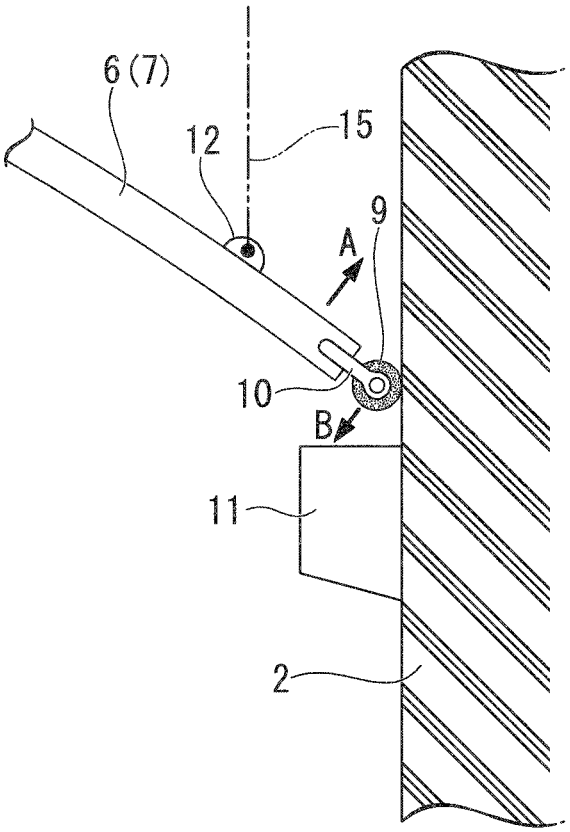
FIG. 4 is a side view of a major part showing attachment of a wheel to a roof beam.

In addition, when the structural skeleton unit 7 is formed in this way, wheels 9 are attached to front end portions of the roof beams 6 as shown in FIG. 4. Accordingly, an intermediate structure that is an embodiment of an intermediate structure of the dome-shaped roof according to the present disclosure and configured to attach the wheels 9 to the front end portions of the roof beams 6 is obtained. The wheels 9 are attached to all of the roof beams 6 having hanging points 12 when the structural skeleton unit 7 is jacked up as will be described below. Although this differs according to the size of the tank to be formed, in this embodiment, for example, the 96 roof beams 6 are assembled in a radial shape from a center when seen in a plan view, and the hanging points 12 are provided on all of the roof beams 6. Accordingly, in the embodiment, the wheels 9 are attached to all of the roof beams 6.

While various methods can be applied to attachment of the wheels 9 without particular limitation, in the embodiment, as shown in FIG. 4, the wheels 9 are attached to front ends of the roof beams 6 via attachment arms 10. That is, the attachment arms 10 are attached to the front end portions of the roof beams 6 along extension lines of the roof beams 6, and the wheels 9 are rotatably axially supported by the front end portions of the attachment arms 10. The wheels 9 have the same structure as tires for an automobile, and are formed of an elastic body such as rubber, a synthetic resin, or the like.

As the wheels 9, wheels having a size with a diameter of about 50 cm to 80 cm are appropriately used such that a person can hold and attach the wheels. The wheels 9 are attached to the roof beams 6 such that the wheels 9 rotatably abut the inner surface of the sidewall 2 to roll in a vertical direction. Conventionally, the roof beams 6 are disposed to have a certain clearance such that front ends thereof do not collide with the inner surface of the sidewall 2. Accordingly, the wheels 9 are attached to the roof beams 6 via the attachment arms 10 so as to fill the clearance.

In that case, the wheels 9 are attached to the front ends of the roof beams 6 in a state in which the wheels 9 are pressed against the inner surface of the sidewall 2 such that the wheels 9 abutting the inner surface of the sidewall 2 receive a reactive force having an appropriate magnitude from the inner surface of the sidewall 2. Specifically, after the attachment arms 10 are fixed to the front ends of the roof beams 6 through bolting, welding, or the like, the wheels 9 are axially supported by the front end portions of the attachment arms 10. Here, for example, by appropriately adjusting attachment of shafts of the wheels 9 to the attachment arms 10, an abutting state (a pressing state) with respect to the inner surface of the sidewall 2 is adjusted. In addition, in the embodiment, the wheels 9 are attached to all of the roof beams 6, and at this time, the abutting states (the pressing states) of the wheels 9 are adjusted such that all of the wheels 9 press the inner surface of the sidewall 2 substantially uniformly. Further, this task can be performed by a worker who gets in a gondola 11 suspended from, for example, a crane or the like.

In addition, before and after attachment of the wheels 9, the hanging points 12 are attached to the front end portions of the roof beams 6 at the time lifting by the jack-up units. A jig as is conventionally used such as a hanging bolt or the like may be used as the hanging points 12. The hanging points 12 are attached to the sidewall 2 side, i.e., the front end portions of the roof beams 6, because the jack-up units need to be attached to the sidewall 2.

Figure 5:
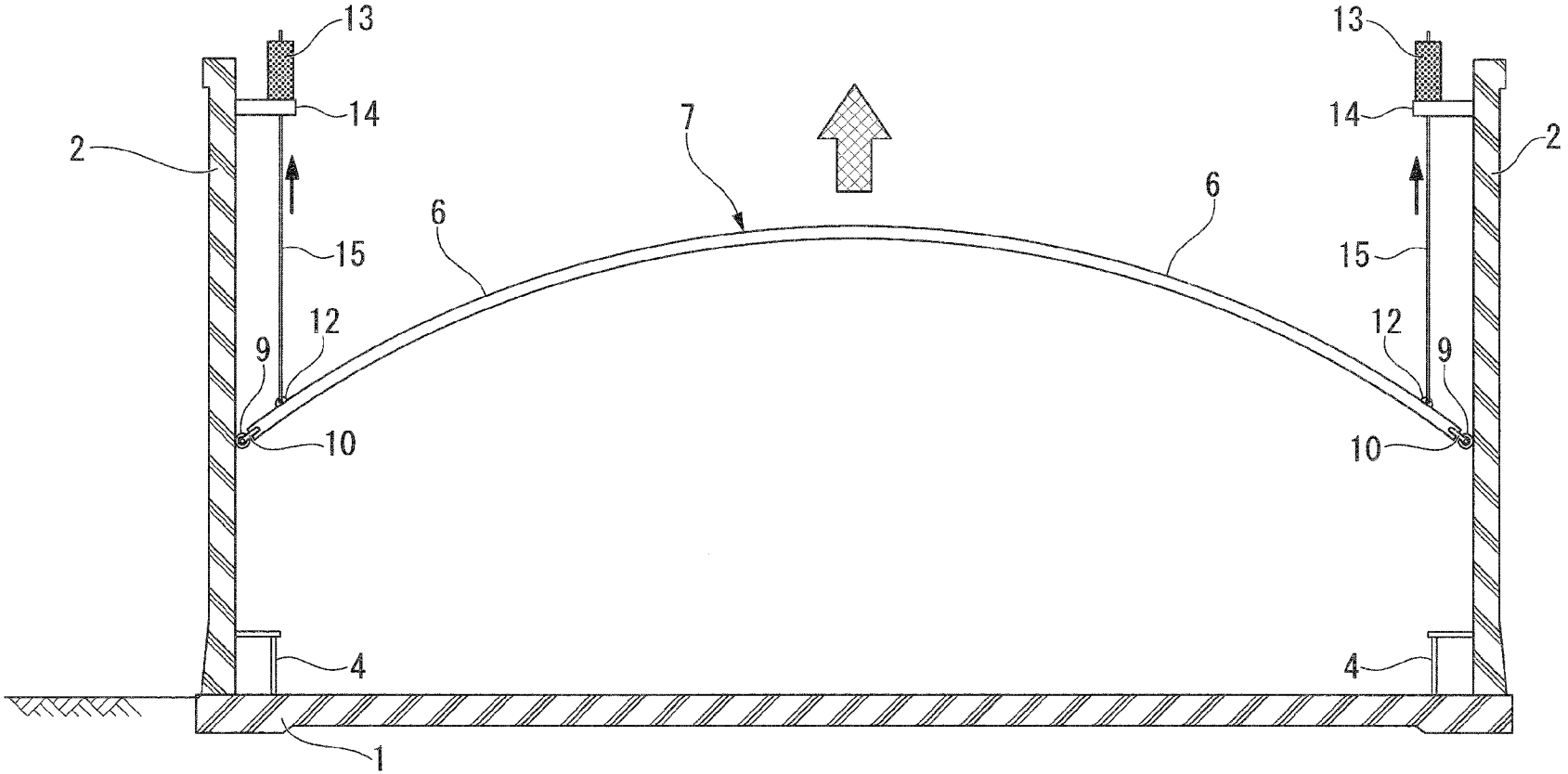
FIG. 5 is a side cross-sectional view showing the process according to the embodiment of the present disclosure.

In parallel with attachment of the wheels 9 or the hanging points 12 to the front end portions of the roof beams 6 or before or after the attachment, the sidewall 2 is completed to the final stage. Then, as shown in FIG. 5, jack-up units 13 are installed at an upper end side of the sidewall 2. The jack-up units 13 that are hydraulic apparatuses known in the art are fixed and installed on support beams 14 disposed to overhang from the inside of the upper end portion of the sidewall 2.

Here, since the hanging points 12 of the roof beams 6 are attached to the sidewall 2 side (the front end portions of the roof beams 6) as described above, the support beams 14 does not largely overhang from the inside of the sidewall 2, and thus the jack-up units 13 can be installed at a position relatively closer to the inner surface of the sidewall 2. Since the jack-up units 13 are disposed in the vicinity of the inner surface of the sidewall 2, when the jack-up units 13 are driven and the structural skeleton unit 7 is lifted, the structural skeleton unit 7 can be stably jacked up without a large rotational moment being generated at a fixed end of the support beam 14, and thus no large load is generated.

In the embodiment, the hanging points 12 are configured to be lifted by the jack-up units 13, respectively. That is, as hanging members 15 constituted by a wire, a rod, or the like, are installed at the jack-up units 13 and hanging jigs (not shown) such as hooks or the like installed at lower ends of the hanging members 15 are hooked to the hanging points 12, the jack-up units 13 hold the hanging points 12. In the embodiment, the number of jack-up units 13 equal to the number of hanging points 12, i.e., the number of the roof beams 6, are installed at the inner surface of the sidewall 2 in a circumferential direction thereof.

When the hanging points 12 of the roof beams 6 corresponding to the jack-up units 13 are held by all of the jack-up units 13 installed in this way, all of the jack-up units 13 are simultaneously driven, and the structural skeleton unit 7 is lifted while being held horizontally. Here, the wheels 9 are attached to the front ends of the roof beams 6 that constitute the structural skeleton unit 7, and all of the wheels 9 abut the inner surface of the sidewall 2 to roll along the inner surface. For this reason, all of the wheels 9 roll along the inner surface of the sidewall 2 to travel along the inner surface.

In that case, as the front end portions of all of the roof beams 6 receive a reactive force from the inner surface of the sidewall 2 via the wheels 9, deformation of the roof beams 6 is suppressed. That is, when lifted by the jack-up units 13, as the front end portions of the roof beams 6 are lifted, in consideration of balance between the central portion and the load of the structural skeleton unit 7, the front end sides of the roof beams 6 are likely to be deformed in a direction shown by an arrow A of FIG. 4, i.e., upward and outward. However, in the embodiment, since the wheels 9 attached to the front ends of the roof beams 6 roll along the inner surface of the sidewall 2 to travel upward, the wheels 9 receive a reactive force in a direction shown by an arrow of FIG. 4, i.e., downward and inward.

Accordingly, deformation in the direction of the arrow A of the roof beams 6 is suppressed by a reactive force in a direction of an arrow B.

Figure 6:
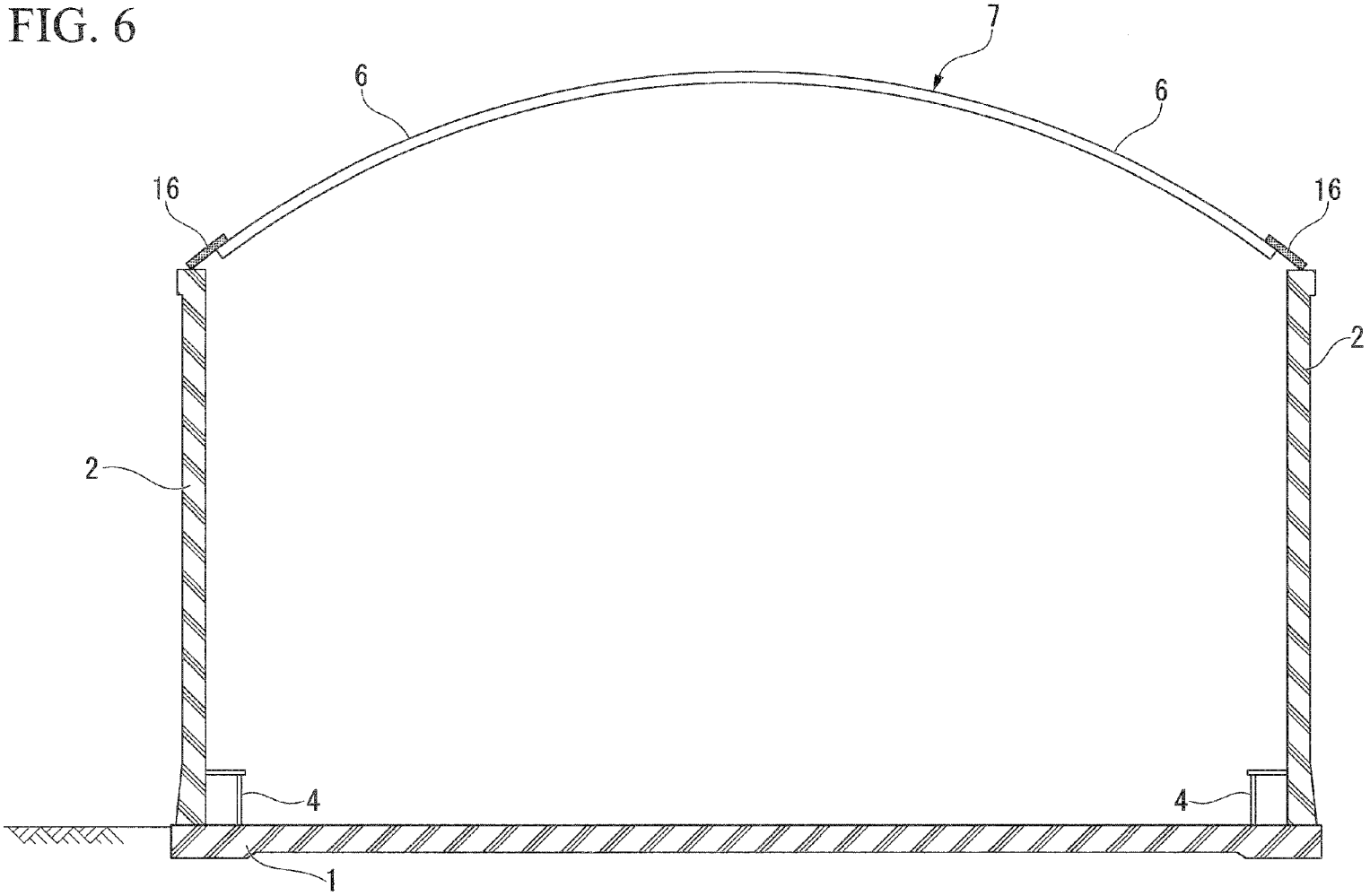
FIG. 6 is a side cross-sectional view showing the process according to the embodiment of the present disclosure.

In parallel with the lifting of the structural skeleton unit 7 by the jack-up units 13 or before or after the lifting, as shown in FIG. 6, a compression ring 16 is attached to an upper end of the sidewall 2 as in the related art. Then, after the structural skeleton unit 7 is lifted to the upper end side of the sidewall 2 by the jack-up units 13, the front end portions of the roof beams 6 that constitute the structural skeleton unit 7 are welded and fixed to the compression ring 16. That is, the structural skeleton unit 7 is indirectly attached and fixed to the upper end portion of the sidewall 2.

When the structural skeleton unit 7 is fixed to the compression ring 16 in this way, locking of the hanging members 15 of the jack-up units 13 to the hanging points 12 of the roof beams 6 is released, and the jack-up units 13 are removed from the sidewall 2 together with the support beams 14. Next, the wheels 9 attached to the roof beams 6 are detached from the attachments arm 10, and the hanging points 12 are also detached.

After that, by assembling a mold (not shown) on the roof plate on the structural skeleton unit 7 and pouring concrete into the mold, the dome-shaped outer tank roof made by reinforced or pre-stressed concrete, i.e., the dome-shaped roof according to the present disclosure, is obtained.

According to the construction method of the dome-shaped roof of the embodiment, since the wheels 9 are attached to the front end portions of the roof beams 6 assembled in the radial shape and the wheels 9 are configured to roll along the inner surface of the sidewall 2 to travel upward when the structural skeleton unit 7 is lifted by the jack-up units 13, as the front end portions of the roof beams 6 receive the reactive force from the inner surface of the sidewall 2 via the wheels 9, deformation of the roof beams 6 can be suppressed. Accordingly, deformation of the entire structural skeleton unit 7 can be suppressed.

In addition, the wheels 9 are attached to the front end portions of the roof beams 6 via the attachment arms 10 without attachment of a scaffolding material constituted by ring-shaped reinforcement shape steel throughout the entire outer circumference of the structural skeleton unit 7 as in the related art. In this case, since the ease of the attachment of the wheels 9 to the roof beams 6 reduces attachment time and the number of wheels 9 is also preferably equal to the number of roof beams 6 serving as attachment targets, the cost of the labor or materials can be reduced. Accordingly, the cost required for construction of the dome-shaped roof can be reduced. Further, since the wheels 9 roll along the inner surface of the sidewall 2 to travel upward, frictional resistance between the inner surface of the sidewall 2 and the wheels 9 is little, and thus the load generated when the roof is jacked up can be reduced.

In addition, while the roof beams 6 lifted by the jack-up units 13 via the hanging points 12 are likely to be deformed in the direction of the arrow A of FIG. 4 because the wheels 9 are attached to all pieces of the roof beams 6 having the hanging points 12 lifted by the jack-up units 13, since the wheels 9 are attached to the roof beams 6 and the roof beams 6 receive the reactive force in the arrow B direction of FIG. 4 via the wheels 9, deformation thereof is suppressed.

In addition, in the embodiment, the wheels 9 are attached to the front end portions of the roof beams 6 of the structural skeleton unit 7 in which the roof beams 6 are assembled in a radial shape when seen in a plan view, thereby constituting an intermediate structure of the dome-shaped roof. For this reason, in the construction method, the intermediate structure is used when the structural skeleton unit 7 is lifted by the jack-up units 13, and the intermediate structure can be easily lifted.

Further, the present disclosure is not limited to the embodiment but various modifications may be made without departing from the spirit of the present disclosure.

For example, in the embodiment, while the hanging points 12 are provided at all of the roof beams 6 and the wheels 9 are attached to all of the roof beams 6 at which the hanging points 12 are provided, the hanging points 12 or the wheels 9 may be attached to only some of the roof beams 6 rather than all of the roof beams 6. Even in this case, like the embodiment, the cost can be reduced in comparison with the related art.

However, even in this case, when a center of the structural skeleton unit 7 is used as a rotational center when the structural skeleton unit 7 is seen in a plan view as shown in FIG. 3, the wheels 9 may be disposed in rotational symmetry with respect to the structural skeleton unit 7. The rotational symmetry has a property in which, assuming that n is an integer of 2 or more, n elements overlap each other when the elements are rotated (360/n)° about a certain center, which is referred to as n-fold symmetry or the like. When the wheels 9 are disposed in rotational symmetry, the structural skeleton unit 7 constituted by the plurality of roof beams 6 is prevented from receiving a reactive force deviated from the sidewall 2 by the wheels 9 disposed at only a portion of the outer circumference, and the structural skeleton unit 7 receives the reactive force substantially uniformly throughout the entire circumference. Accordingly, deformation of the entire structural skeleton unit 7 can be favorably suppressed.

INDUSTRIAL APPLICABILITY

It is possible to provide a construction method of a dome-shaped roof and an intermediate structure of the dome-shaped roof that are capable of reducing a load generated when the dome-shaped roof is jacked up to facilitate construction thereof and reduce cost thereof.

What is claimed is:

1. A method of constructing a dome-shaped roof in a cylindrical tank body, the construction method comprising:

a step of assembling roof beams into the tank body in a radial shape when seen in a plan view to form a structural skeleton unit of the dome-shaped roof;

a step of fixing a roof plate onto the structural skeleton unit;

a step of attaching wheels to front end portions of the roof beams and causing the wheels to abut an inner surface of the tank body in a state in which the wheels are able to roll in a vertical direction, the wheels being attached to the front end portions of the roof beams by attaching attachment arms to the front end portions of the roof beams so that the attachment arms extend along extension lines of the roof beams, and rotatably axially supporting the wheels by front end portions of the attachment arms;

a step of, after the roof plate is fixed onto the structural skeleton unit, lifting the structural skeleton unit by jacks installed at an upper end side of the tank body and causing the wheels to roll along the inner surface of the tank body to travel upward;

a step of directly or indirectly attaching and fixing the structural skeleton unit to an upper end portion of the tank body after the structural skeleton unit is lifted to the upper end side of the tank body; and a step of, after the structural skeleton unit is fixed to the upper end portion of the tank body, placing concrete on the roof plate, wherein, when a center of the structural skeleton unit is used as a rotational center when seen in a plan view, the wheels are disposed at least in rotational symmetry with respect to the structural skeleton unit.

2. The construction method of the dome-shaped roof according to claim 1, wherein the wheels are attached to all of the roof beams having hanging points lifted by the jacks.

3. The construction method of the dome-shaped roof according to claim 2, wherein the hanging points lifted by the jacks are provided at all of the roof beams.

4. The construction method of the dome-shaped roof according to claim 1, wherein hanging points lifted by the jacks are provided at all of the roof beams.

5. The construction method of claim 1, wherein the number of wheels attached to the roof beams is n, and a spacing between the wheels in the structural skeleton unit is 360°/n.

6. The construction method of claim 1, further comprising assembling a mold on the roof plate, wherein the concrete is poured in the mold, thereby completing construction of the dome-shaped roof in the cylindrical tank body.

* * * * *